US007516556B2

(12) United States Patent
Yepes Segovia et al.

(10) Patent No.: US 7,516,556 B2
(45) Date of Patent: Apr. 14, 2009

(54) METHOD OF AUTOMATICALLY GRADING ARTICLES, IN PARTICULAR, GARMENTS

(75) Inventors: Ramon Yepes Segovia, Madrid (ES); Maria de los Angeles Encinas Arias, Madrid (ES)

(73) Assignee: Lectra (FR)

( * ) Notice: Subject to any disclaimer, the term of this patent is extended or adjusted under 35 U.S.C. 154(b) by 0 days.

(21) Appl. No.: 10/572,771

(22) PCT Filed: Aug. 30, 2005

(86) PCT No.: PCT/FR2005/050689

§ 371 (c)(1),
(2), (4) Date: Mar. 20, 2007

(87) PCT Pub. No.: WO2006/027523

PCT Pub. Date: Mar. 16, 2006

(65) Prior Publication Data

US 2007/0169358 A1 Jul. 26, 2007

(30) Foreign Application Priority Data

Aug. 31, 2004 (FR) ..... 04 09235

(51) Int. Cl.
*A41H 3/00* (2006.01)

(52) U.S. Cl. ..... 33/17 A; 700/132

(58) Field of Classification Search ..... 33/17 A, 33/17 R; 700/131, 132, 134
See application file for complete search history.

(56) References Cited

U.S. PATENT DOCUMENTS 4,677,564 A * 6/1987 Paly et al. ..... 700/134
5,570,533 A * 11/1996 Vouyouka ..... 33/17 A
5,757,661 A 5/1998 Surville et al.
6,173,211 B1 * 1/2001 Williams et al. ..... 700/131
6,907,310 B2 * 6/2005 Gardner et al. ..... 700/132
2005/0022708 A1 * 2/2005 Lee ..... 112/186
2007/0169358 A1 * 7/2007 Segovia et al. ..... 33/17 A

FOREIGN PATENT DOCUMENTS

| | | |
|---|---|---|
| FR | 2056191 | 5/1971 |
| FR | 2561801 | 9/1985 |
| GB | 1571290 | 7/1980 |
| RU | 2057472 C1 * | 4/1996 |

* cited by examiner

*Primary Examiner*—R. Alexander Smith
(74) *Attorney, Agent, or Firm*—Smith, Gambrell & Russell

(57) ABSTRACT

For an article of a given type, in particular a garment, a grading mask is used that has images of the pieces of a reference article, geometrical grading regions, each of which contains one or more characteristic points of a piece of the reference article, and grading formulae associated with respective ones of the various regions, each grading formula making it possible, in the associated grading region, and as a function of the variation in one or more magnitudes of a scale of measurements, or of a predetermined increment value, to determine a displacement to be applied to each characteristic point contained in said region for going from the base size to another size. Images of the pieces of the article to be graded for an article size corresponding to the base size of the grading mask are called up, said images are placed on the grading mask in positions corresponding to the positions of the pieces of the mask, and the pieces are graded automatically on the basis of the grading formulae of the mask and of a chosen scale of measurements.

14 Claims, 4 Drawing Sheets

METHOD OF AUTOMATICALLY GRADING ARTICLES, IN PARTICULAR, GARMENTS

BACKGROUND OF THE INVENTION

The present invention relates to a method of grading an article of a given type, in particular a garment, formed by assembling a plurality of pieces.

Garments are generally made by assembling a plurality of pieces which correspond to a base model or pattern and each of which is in the form of a plane developed area having a particular outline and optionally certain additional internal markers.

The size of a garment is determined mainly relative to particular measurements such as chest size, neck size, hip size, etc., and by the style that is to be given to the garment (tight-fitting or loose-fitting style, for example). The various measurements are organized into scales of sizes or tables of measurements which differ depending on the targeted population.

For each piece of a garment, grading is thus the operation that consists in obtaining, from a base model corresponding to a base size, additional patterns that are of different (larger or smaller) sizes as a function of a given scale of measurements, but that remain similar, as regards their shapes, to the base model.

Grading then makes it possible to obtain the geometrical layouts of the pieces in the various sizes, which is necessary for preparing to cut the pieces out from the material out of which the garment is to be made, which material can, for example, be a woven fabric, leather, or any other desired natural or synthetic material.

Grading also applies to all of the other fields in which articles of different sizes are made that must correspond to a base model, such as, for example, the field of shoemaking.

When grading is applied to a garment, it is already known that characteristic points or "outline points" can be marked on the pieces of the base model, knowledge of the outline points making it possible to reconstruct, in full, the images of the pieces, optionally also with markers internal to said pieces.

For each different size, grading thus consists in determining the characteristic points corresponding to the characteristic points of the base model, and in applying grading rules with reference to a given scale of measurements. On the basis of the characteristic points determined in this way, the image of the base model for the size in question can be plotted automatically, which enables automatic cutting-out to be performed subsequently.

Since numerous grading rules exist for each type of garment and for each scale of measurements, the main difficulty in applying such a method lies in choosing the proper grading rule for each characteristic point of each piece of the garment, on the basis of a given base size. Often, the knowledge and know-how of experienced staff is used.

OBJECT AND SUMMARY OF THE INVENTION

An object of the invention is precisely to remedy such drawbacks by proposing a method that is simple to use and that enables articles to be graded automatically, for various sizes and regardless of the chosen scale of measurements.

According to the invention, these objects are achieved by means of a method characterized in that it consists in: using a grading mask having images of the pieces of a reference article of the same type as the type of the article to be graded and for a given base size, a plurality of geometrical grading regions, each of which contains one or more characteristic points of a piece of the reference article, and grading formulae associated with respective ones of the various regions, each grading formula making it possible, in the associated grading region, and as a function of the variation in one or more magnitudes of a scale of measurements, or of a predetermined increment value, to determine a displacement to be applied to the or to each characteristic point contained in said region for going from the base size to another size; calling up the images of the pieces of the article to be graded for an article size corresponding to the base size of the grading mask; placing the images of the pieces of the article to be graded on the grading mask in positions corresponding to the positions of the pieces of the mask; and automatically grading the pieces of the article to be graded on the basis of the grading formulae of the mask and of a chosen scale of measurements for the article to be graded.

The method of the invention thus offers numerous advantages. In particular, it is automatic and simple to use; apart from the images of the pieces of the article to be graded, from the chosen scale of measurements, and from the existing grading mask, no other element is necessary for implementing it. In addition, the same grading method established for a given style of article can be applied to styles that are similar to it, and to various scales of measurements. By expressing the grading steps in a visual and geometrical mode, the method also makes it possible to see how applying the grading formulae of the scale of measurements affects the grading of each piece of the article.

According to a particular characteristic of the invention, when a characteristic point of a piece of the article to be graded is included in a plurality of grading regions of the grading mask, the grading formulae of each of said grading regions apply cumulatively to said characteristic point.

The step of placing the images of the pieces of the article to be graded in correspondence with the images of the pieces of the grading mask is followed by revising one or more grading regions of the mask so that each grading region that includes a characteristic point of a piece of the mask also includes the corresponding characteristic point of the article to be graded.

In order to comply with certain particular constraints of the article to be graded, it is possible to use a grading mask that also includes one or more special grading regions, each of which includes an outline portion of a piece of the mask and at least one special grading formula associated with each special grading region and specifying a constraint to be applied to the portion of the outline during the grading, and, during the grading, the special grading formula associated with a special grading region that contains one or more outline portions of the piece of the article to be graded is applied to the or to each outline portion.

In which case, the special grading formula expresses a constraint chosen from at least one of the following outline portion constraints: shape constraint, length constraint, and orientation constraint.

The invention also provides a method of creating a grading mask, said method being characterized in that it consists in: using images of the pieces of a reference article of this type for a given base size; positioning the images of the pieces of the article in a plane; creating grading regions, each of the grading regions being defined by a geometrical zone of the plane and containing at least one characteristic point of a piece of the article; and associating each grading region with a grading formula making it possible, in the associated grading region, and as a function of the variation in one or more magnitudes of a scale of measurements, or of a predetermined increment value, to determine a displacement to be applied to the or to each characteristic point contained in said region for going from the base size to another size.

The invention also provides a grading mask characterized in that it has images of the pieces of a reference article of the same type as the type of the article to be graded and for a given base size, a plurality of geometrical grading regions, each of which contains one or more characteristic points of a piece of the reference article, and grading formulae associated with respective ones of the various regions, each grading formula making it possible, in the associated grading region, and as a function of the variation in one or more magnitudes of a scale of measurements, or of a predetermined increment value, to determine a displacement to be applied to the or to each characteristic point contained in said region for going from the base size to another size.

The invention also provides a set of grading masks as defined above, the grading masks being in a digital form.

BRIEF DESCRIPTION OF THE DRAWINGS

Other characteristics and advantages of the present invention appear from the following description given with reference to the accompanying drawings which show an implementation of the invention that is not limiting in any way. In the figures.

DETAILED DESCRIPTION OF AN IMPLEMENTATION

In the following description, consideration is given to grading the pieces of a garment. However, the invention is also applicable to grading pieces of articles other than garments, e.g. shoes or other footwear, which are also made in different sizes that are to correspond to a base model.

Grading Method

Figure 1:
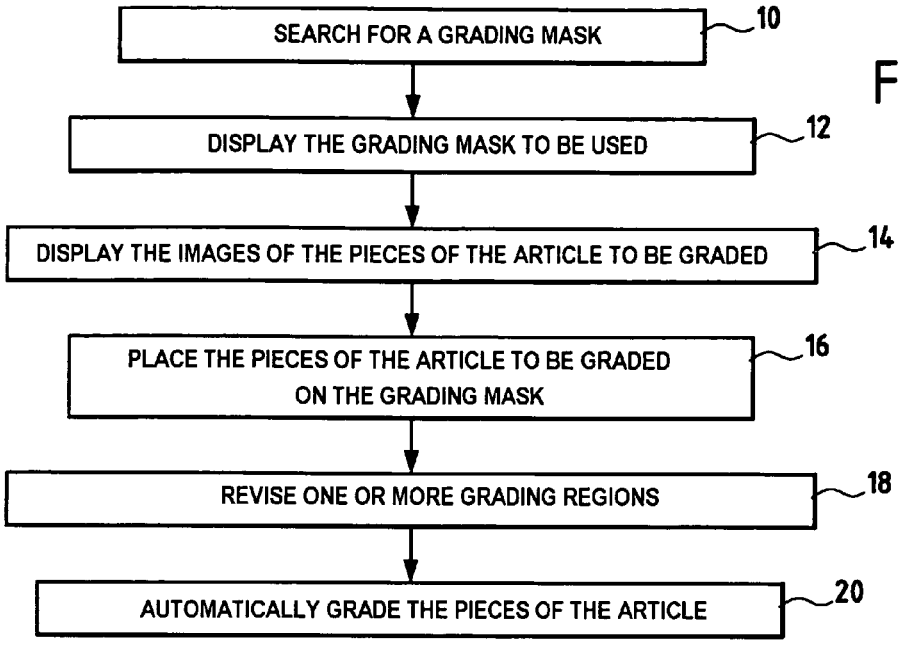
FIG. 1 is a flow chart showing various steps in implementing a grading method of the invention.

Reference is made firstly to FIG. 1 which shows the steps in a particular implementation of a grading method of the invention.

In general, the grading method of the invention can be implemented by means of a computer system equipped, in particular with a graphics workstation and with grading software. The graphics workstation can be of the same type as computer-aided design (CAD) software for designing garments.

In a first step (10) of the method, the operator searches for and uses a grading mask having images of the pieces of a reference garment of the same type as the garment to be graded for a given base size.

The grading mask, whose creation method is described below, also has a plurality of grading geometrical regions, each of which contains one or more characteristic points that are characteristic of a piece of the reference garment, and grading formulae associated with respective ones of the different regions.

Inside the associated grading region, and as a function of the variation of one or more magnitudes of a scale of measurements or of a predetermined increment value, each grading formula makes it possible to determine a displacement to apply to the or to each characteristic point contained in said region in order to go from the base size to another size.

The grading mask can also have one or more special grading regions, each of which includes a portion of the outline of a piece of the mask and at least one special grading formula associated with each special grading region and specifying a constraint to be applied to the portion of the outline during grading.

In order to help the operator in searching for the grading mask to be used, the images of the pieces of the reference garment that are contained in the mask can be positioned in a plane in relative positions that are substantially similar to their assembly positions for forming the article.

The grading mask is advantageously in a digital form that can be stored, e.g. in a database of the grading computer system.

The following step (12) consists in displaying, e.g. on the screen of the workstation, the grading mask to be used (i.e. the images of the pieces of the reference garment and the grading geometrical regions that are associated with them).

During another step (14) of the grading method, the operator calls up, e.g. onto the screen of the workstation, images of the pieces of the garment to be graded for a garment size corresponding to the base size of the grading mask.

In a manner known per se, the images of the pieces of the garment to be graded are produced while designing the garment, in particular by using a CAD system. They are also in digital form and are stored in a memory or in a database of the graphics workstation.

The following step (16) of the method consists, for the operator, in placing the images of the pieces of the garment to be graded on the grading mask in positions corresponding to the positions of the pieces of the reference article contained in the mask.

This operation (16) of superposing images can be performed manually by the operator, e.g. by means of a suitable tool of the mouse type. It consists in causing the positions of the pieces of the garment that is to be graded to correspond as closely as possible with the positions of the pieces of the grading mask.

The names of the characteristic points of the pieces of the garment to be graded can already be included in the digital images called up on the workstation. They can also be assigned by the operator by matching with the names of the pieces of the reference garment when the images have been superposed.

The superposition operation can also be performed automatically by a method optionally also making it possible to assign names to the characteristic points of the pieces of the garment to be graded so that they match the names of the characteristic points of the pieces of the grading mask.

In practice, such a method consists, for the operator, in placing the images of the pieces of the garment to be graded substantially in correspondence with the pieces of the grading mask. A computer routine involving convolution analyzes the sequence of the consecutive angles and relative side lengths of the segments of the pieces in order to determine the best superposition of the pieces of the garment to be graded on the pieces of the grading mask. On the basis of these relative positions of the pieces, the names of the characteristic points can be assigned automatically to the pieces of the garment to be graded by means of proximity and by angular interval value.

If necessary, the step (16) of placing the images of the pieces of the garment to be graded in correspondence with the images of the pieces of the grading mask can be followed by revising one or more grading regions of the mask so that each grading region that includes a characteristic point of a piece of the mask also includes the corresponding characteristic point of the corresponding piece of the article to be graded (step 18).

The step (18) of revising the grading regions of the mask can be performed manually by the operator, e.g. by selecting, by means of a mouse, the various grading regions that are to be modified.

Once the images of the pieces of the garment to be graded are correctly positioned on the grading mask, the last step (20) of the grading method consists in automatically performing the grading proper of the pieces of the garment to be graded.

The grading (20) is performed on the basis of the grading formulae of the mask and of a scale of measurements chosen for the garment to be graded.

Optionally, during the grading (20), a special grading formula associated with a special grading region is applied to the or each outline portion of the piece of the garment to be graded that is contained in said special grading region.

Provision can be made during the grading step (20) for automatically adjusting the way the images of the pieces of the garment are disposed relative to one another, in particular in order to avoid said pieces overlapping when grading a garment to a size larger than the size of the reference garment.

Grading Mask

The various steps in the method of creating a grading mask of the invention are described below with reference to FIGS. 2 and 3.

Figure 2:
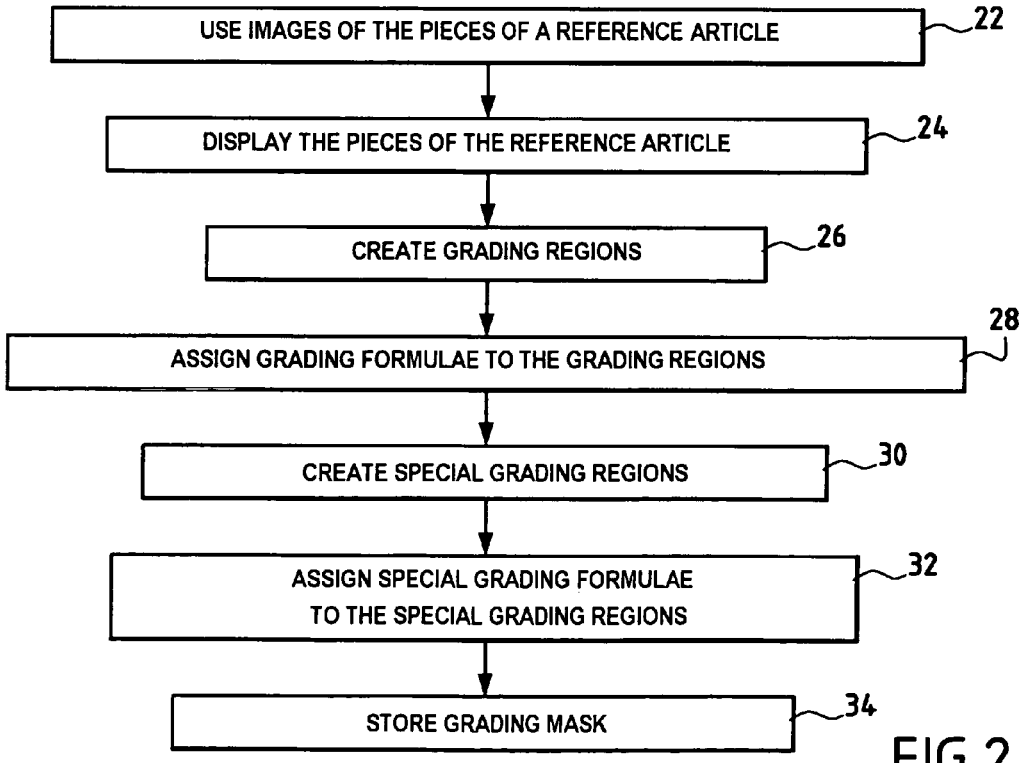
FIG. 2 is a flow chart showing various steps in implementing a method of creating a grading mask of the invention.

FIG. 2 shows the steps of a particular implementation of the method of creating a grading mask.

Figure 3:
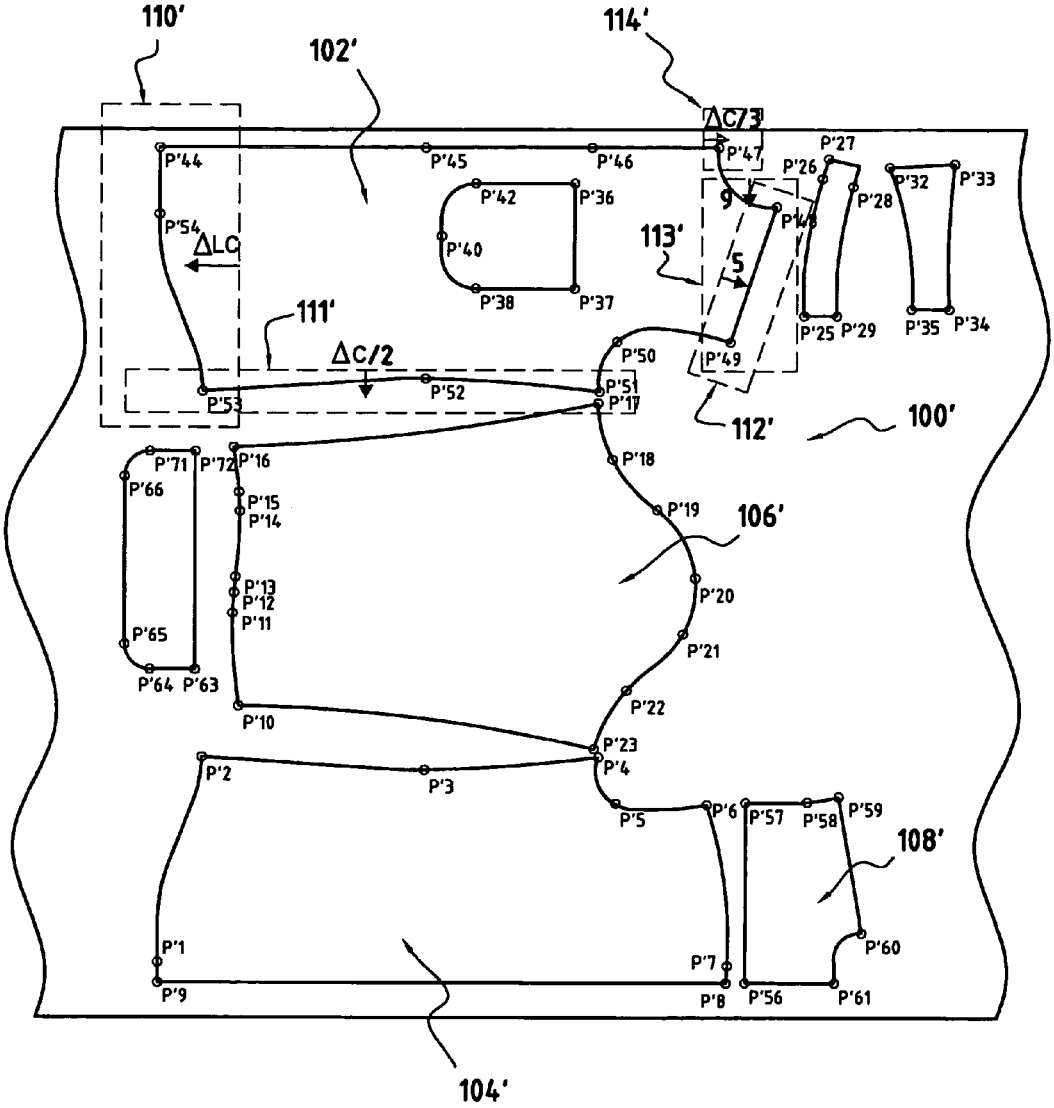
FIGS. 3 to 7 show various steps in the grading method of the invention as applied to the example of a shirt.

FIG. 3 shows a fragmentary example of a grading mask for a reference shirt having a given base size.

As in the grading method of the invention, the method of creating a grading mask can be implemented by means of a computer system equipped in particular with a graphics workstation and with grading software.

In a first step (22) of the method, use is made of images of the pieces of a reference garment of a given type for a given base size.

In the example in FIG. 3, the reference garment is a shirt 100'. The shirt is made up of various pieces, and in particular of a front piece 102', of a back piece 104', of a sleeve 106', and of an "armseye" or armhole piece 108'.

Each of the pieces of the reference shirt is defined by its characteristic points or "outline points", knowledge of which makes it possible to reconstruct the image in full.

For example, the outline of the front piece 102' is identified by its characteristic points P'44 to P'53.

The images of the pieces of the reference garment are displayed, e.g. on the screen of the workstation of the grading computer system, and they are positioned in a plane (step 24).

As shown in FIG. 3, the images of the pieces of the reference shirt can be positioned in the plane in positions substantially similar to their assembly positions for forming the shirt.

The next step (26) of the method consists in creating grading regions, each of which is defined by a geometrical zone of the plane, and each of which contains at least one characteristic point of a piece of the reference garment.

The geometrical zones of the grading regions can be defined by polygonal shapes (e.g. rectangles), by two concurrent straight lines or by a single straight line defining a half-plane.

They are created visually by the operator, e.g. by means of the graphics workstation of the grading computer system.

In the example shown in FIG. 3, the grading regions of the mask are shown diagrammatically, but only for the front piece 102' of the reference shirt 100'. Said regions are shown as dashed-line rectangles 110' to 114'.

Each of the grading regions 110' to 114' contains at least one characteristic point of the piece 102'.

It can be observed that the same characteristic point of the piece 102' can be contained in a plurality of different grading regions (this applies in particular to points P'48, P'49, and P'53).

Similarly, certain characteristic points, such as P'45 and P'46 can belong to none of the grading regions.

In the next step (28) of the method of creating the mask, each grading region is associated with a grading formula making it possible, in the associated grading region and as a function of the variation of one or more magnitudes of a scale of measurements or of a predetermined increment value, to determine a displacement to be applied to the or to each characteristic point contained in said region for going from the base size to another size.

The grading formulae associated with the grading regions are created using the measurement mnemonics of a measurement scale.

In the example of FIG. 3, such grading formulae that are associated with respective ones of the grading regions of the front piece 102' are also shown in rectangles 110' to 114'.

For example, for the grading region 111', the grading formula is $\Delta/2$ and it is associated with a grading direction (shown by a displacement vector).

The grading formulae $\Delta C/2$ refers to a chosen scale of measurements, and, in this particular case, it specifies that all of the characteristic points of the piece to be graded that are contained in the grading region 111' must be incremented, depending on the value of the base size, and in the direction represented by the displacement vector by one half of the variation ($\Delta$) of the value of the "Chest" measurement indicated in the scale.

The following table is an example showing part of a scale of measurements for a targeted population, and that makes it possible to give a practical example of how such a grading formula is applied.

| | | SIZES | | | | | | | | | | | |
|---|---|---|---|---|---|---|---|---|---|---|---|---|---|
| Name | Measurement | 36 | 38 | 40 | 42 | 44 | 46 | 48 | L1 | L2 | L3 | L5 | L6 |
| C | Chest | 465 | 489 | 512 | 518 | 524 | 539 | 536 | | | | | |
| N | Neck | 223 | 229 | 238 | 241 | 248 | 245 | 260 | | | | | |
| L | Length | 772 | 758 | 794 | 801 | 807 | 814 | 820 | | | | | |
| LC | Length configuration | | | | | | | | 20 | 10 | 0 | 10 | 20 |

The starting assumption is that the reference shirt is size 40 (with a length corresponding to the size L3), and that it is desired to obtain a shirt of size 42.

The grading formula ΔC/2 for the grading region 111' thus indicates that all of the characteristic points of the piece to be graded that are included in said region must be incremented "downwards" by the value (518−512)/2, i.e. 3.

Similarly, since the grading formula for the region 114' is ΔC/3 associated with a displacement vector, all of the characteristic points of the piece to be graded and included in said region are incremented "rightwards" by the value (518−512)/3 i.e. 2.

It should be noted that the grading formula of the region 110' is ALC associated with a displacement vector. For the same base size (size 40 in this example), such a grading formula makes it possible to obtain a plurality of possible shirt lengths represented in the scale of measurements by respective ones of the values L1, L2, L3, L5, and L6.

It should also be noted that, since the point P'53 belongs to two grading regions 110' and 111', the characteristic point of the piece to be graded is graded simultaneously both by the grading formula ΔC/2 associated with its grading direction, and by the grading formula ΔLC associated with its displacement vector.

The grading mask can thus have one or more grading regions, the grading formula of each region being a function of a predetermined increment value. In the example of FIG. 3, the grading regions are grading regions 112' and 113' for which the respective grading formulae are "5" and "9", each of which is associated with a displacement vector.

Thus, for the region 112', the grading formula "5" indicates that the amplitude of the displacement of all of the characteristic points of the piece to be graded and contained in said region corresponds, for grading between two consecutive sizes, to the predetermined value of 5 millimeters (mm) and to the direction represented by the displacement vector.

In addition, in the example shown in FIG. 3, the grading directions associated with the various grading formulae are represented by displacement vectors that correspond to grading the front piece 104' for a size larger than the size of the reference piece.

If it is desired to grade the piece to a size smaller than the size of the reference piece, an angle of 180° should be assigned to said displacement vectors. More generally, when the increment difference between the size to be reached and the size of the reference piece is negative, an angle of 180° should be assigned to the displacement vectors shown in FIG. 3.

Thus, if it is desired to obtain a shirt of size 38 (corresponding to size L2), all of the characteristic points of the piece to be graded and included in the region 114' are incremented "leftwards" by the value 2.

It is also possible to create one or more special grading regions, each of which includes a portion of the outline of a piece of the mask (step 30).

Each of the special grading regions is associated with a special grading formula specifying a constraint to be applied to the portion of the outline during grading (step 32).

For example, the constraint to be applied to the portion of the outline can be a shape, length, or orientation constraint.

The characteristic points of the piece to be graded that are included both in a special grading region and in an above-defined standard grading region are graded independently using the respective grading procedures (special and standard).

An example of a special grading region is explained below with reference to FIG. 3.

For such a reference shirt, special grading regions can be created for the outline portions of the front piece 102' and of the back piece 104' that lie respectively in the range defined by points P'49 to P'51 and in the range defined by points P'4 to P'6 (corresponding to the armholes of the shirt), for the portion of the outline of the sleeve 106' that lies in the range defined by points P'17 to P'23, and for the portion of the outline of the armhole piece 108' defined by points P'57 to P'59.

For example, these special grading regions can be associated with the following special grading formulae:

$$L(P'17, P'20)=L(P'51, P'49) \quad (1)$$

$$L(P'20, P'23)=L(P'4, P'6)+L(P'57, P'59) \quad (2)$$

Formula (1) thus specifies that the portion of the sleeve of the shirt to be graded that lies in the range defined by points P'17 to P'20 of the mask should, on being graded, and for each size, keep the same length proportion as the length proportion known for the base size.

Similarly, formula (2) indicates that the shape of the sleeve of the shirt to be graded that lies in the range defined by points P'20 to P'23 of the mask should, on being graded, and for each size, have the same length proportion as the corresponding length defined by points P'6 to P'4 of the back piece in the same size, plus the length defined by points P'57 to P'59 of the armhole piece.

Another example of a special grading formula is as follows:

$$R(P'a, P'b, P'c, \text{direction}, \text{parameter}) \quad (3)$$

Such a formula (3) indicates that the portion of the outline of the piece to be graded that lies in the range defined by points P'a and P'b of the mask should, on being graded, be subjected to rotation about a point P'c in a specified direction (clockwise or counterclockwise) through a number of degrees indicated by the parameter.

This type of formula (3) can be necessary when, for example, grading darts in a garment, the angle at the points of the darts changing with changing size by a constant quantity per size or as a function of one of the measurements of the body.

The resulting grading mask can then be stored (step 34), e.g. in digital form, in a database of the grading computer system containing a set of grading masks each associated with a particular reference garment.

Example of Application of the Grading Method

This example relates to automatically grading a shirt formed by assembling a plurality of pieces.

Above-described FIG. 3 shows a fragmentary example of a grading mask that can be applied to grading such a shirt.

Figure 4:
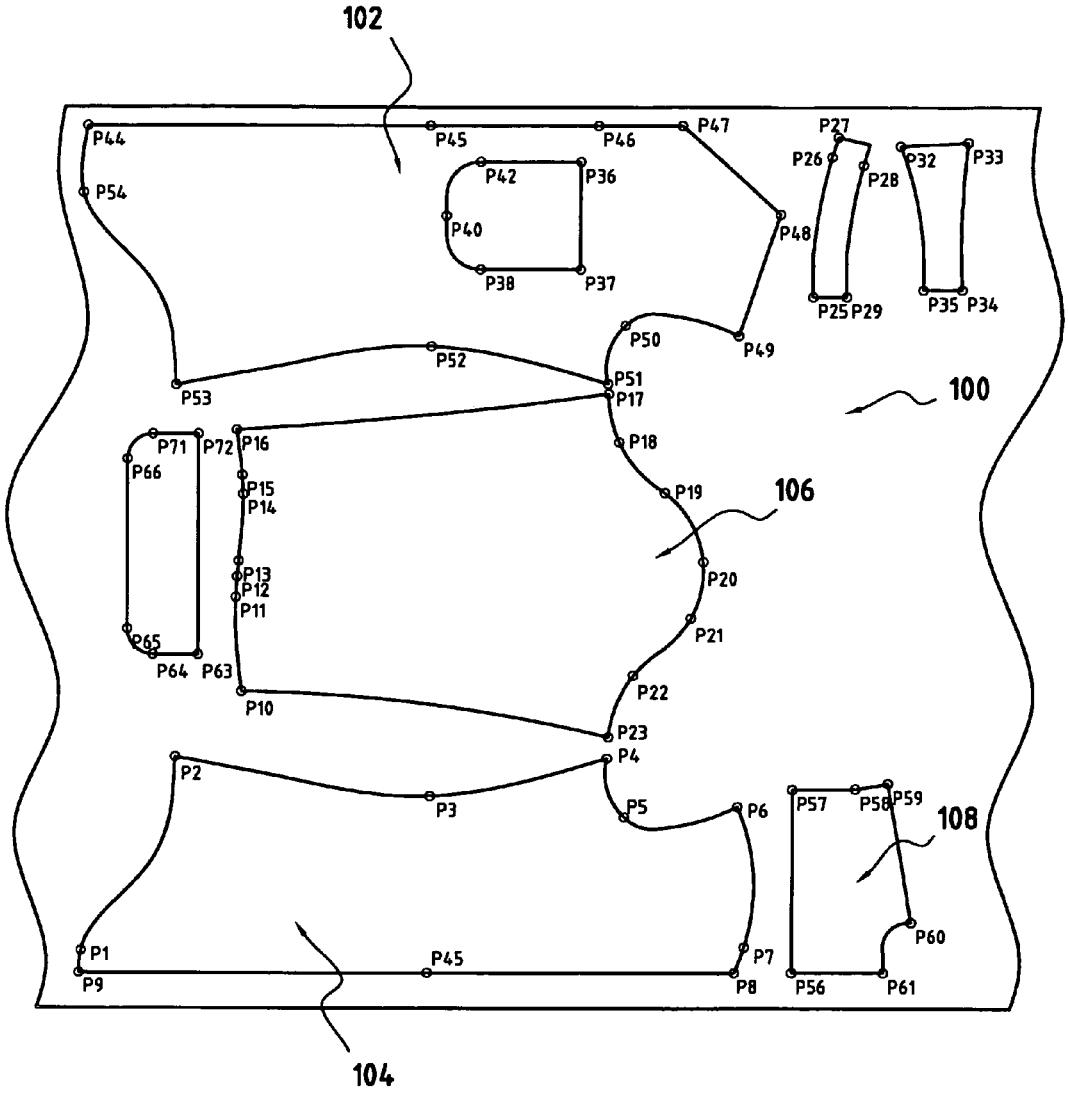

FIG. 4 shows an example of an image of the shirt to be graded. In FIG. 4, the shirt 100 is made up of various pieces, and, in particular, of a front piece 102, of a back piece 104, of a sleeve 106, and of an armhole piece 108, each of the pieces having characteristic points.

In this example, the various component pieces of the shirt are positioned in a plane in relative positions similar to the positions in which they are assembled to form the shirt.

In the first step (10) of the grading method, the operator uses the grading mask of FIG. 3 which has images of the pieces of the reference shirt of the same type as the shirt to be graded.

Figure 5:
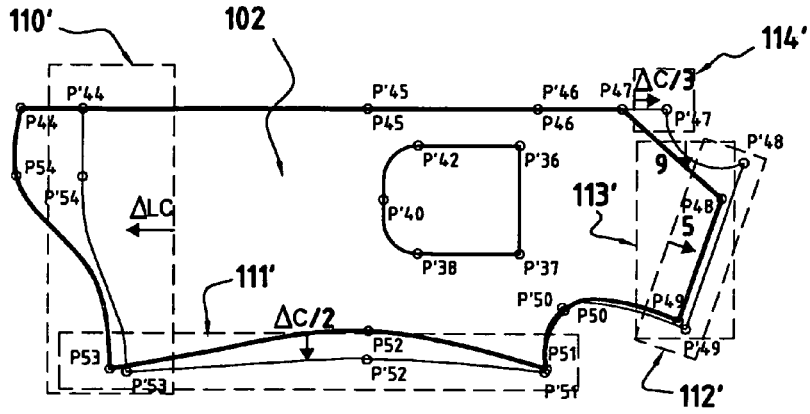

The step (16) of placing the images of the pieces of the shirt to be graded on the grading mask in positions corresponding to the positions of the pieces of the mask is shown in FIG. 5.

For reasons of clarity, the figures show only the placing of the image of the front piece 102 of the shirt to be graded on the corresponding piece 102' of the reference shirt contained in the mask.

In this embodiment, the superposition of the piece 102 on the piece 102' of the grading mask is not perfect.

Certain characteristic points of the front piece 102 of the shirt to be graded are not included in the grading regions of the mask that are assigned to them. This applies in particular to points P44 and P55 that are to be associated with the grading region 110' of the mask, to point P52 of the grading region 111', and to point P42 of the grading region 114'.

The step (18) of revising one or more grading regions of the mask makes it possible to solve this problem by making provision for the grading regions 110', 111', and 114' of the mask also to include the respective characteristic points P44, P54, P52, and P47 of the front piece 102 of the shirt to be graded.

Figure 6:
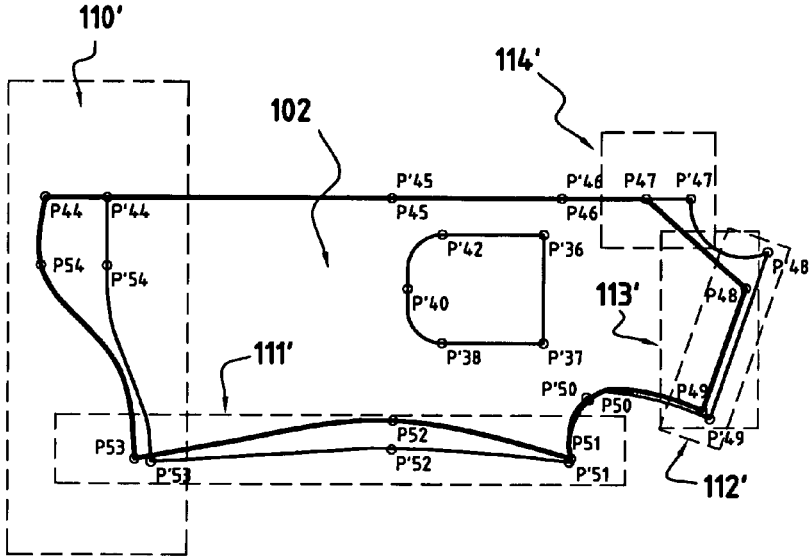

FIG. 6 shows an implementation of such a step of revising the grading regions.

In FIG. 6, the grading regions 110', 111' and 114' of the mask have thus been revised so as to be enlarged to include respective ones of the characteristic points P44, P54, p 52, and P47 of the front piece 102.

Once the images of the front pieces 104 of the shirt to be graded have been positioned correctly on the grading mask, the front piece 104 can be graded automatically.

Figure 7:
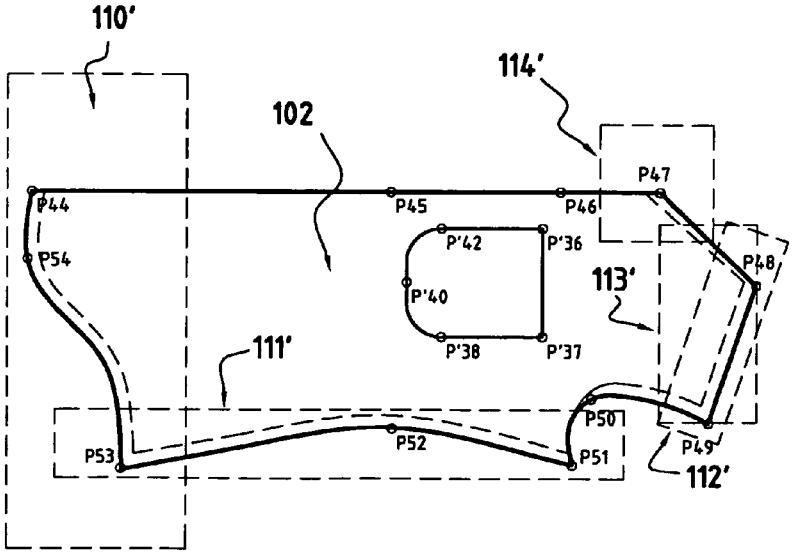

FIG. 7 shows an example of the result of grading obtained for the front piece 104 of the shirt when grading to a size larger than the base size of the reference shirt. The outline of the piece in dashed lines shows the base size and the outline of the piece in uninterrupted lines shows the larger size obtained.

Thus, only the creation of the grading masks for the various types of garment requires the know-how and knowledge of experienced professionals. A mask that is pre-established for one type of garment can then be used very easily without needing any particular expertise.

The invention claimed is:

1. A method of automatically grading an article of a given type, in particular an article of a garment type, that is formed by assembling a plurality of pieces, said method comprising:

using a grading mask having images of the pieces of a reference article of the same type as the type of the article to be graded and for a given base size, a plurality of geometrical grading regions, each of which contains one or more characteristic points of a piece of the reference article, and grading formulae associated with respective ones of the various regions, each grading formula making it possible, in the associated grading region, and as a function of the variation in one or more magnitudes of a scale of measurements, or of a predetermined increment value, to determine a displacement to be applied to each characteristic point contained in said region for going from the base size to another size;

calling up the images of the pieces of the article to be graded for an article size corresponding to the base size of the grading mask;

placing the images of the pieces of the article to be graded on the grading mask in positions corresponding to the positions of the pieces of the mask; and automatically grading the pieces of the article to be graded on the basis of the grading formulae of the mask and of a chosen scale of measurements for the article to be graded.

2. The method according to claim 1, wherein the one or more characteristic points of the piece of the article to be graded is included in the plurality of grading regions of the grading mask, the grading formulae of each of said grading regions apply cumulatively to the one or more characteristic points.

3. The method according to claim 2, wherein the step of placing the images of the pieces of the article to be graded in correspondence with the images of the pieces of the grading mask is followed by revising one or more of the grading regions of the mask so that each grading region that includes the one or more characteristic points of the piece of the mask also includes the corresponding one or more characteristic points of the article to be graded.

4. The method according to claim 2, wherein the grading mask also includes one or more special grading regions, each of which includes an outline portion of a piece of the grading mask and at least one special grading formula associated with each special grading region and specifying a constraint to be applied to the portion of the outline during the grading, and, during the grading, the special grading formula associated with a special grading region that contains one or more outline portions of the piece of the article to be graded is applied to the or to each outline portion.

5. The method according to claim 1, wherein the step of placing the images of the pieces of the article to be graded in correspondence with the images of the pieces of the grading mask is followed by revising one or more of the grading regions of the mask so that each grading region that includes the one or more characteristic points of the piece of the mask also includes the corresponding one or more characteristic points of the article to be graded.

6. The method according to claim 5, wherein the grading mask also includes one or more special grading regions, each of which includes an outline portion of a piece of the grading mask and at least one special grading formula associated with each special grading region and specifying a constraint to be applied to the portion of the outline during the grading, and, during the grading, the special grading formula associated with a special grading region that contains one or more outline portions of the piece of the article to be graded is applied to the or to each outline portion.

7. The method according to claim 6, wherein the special grading formula expresses the constraint chosen from at least one of the following outline portion constraints: shape constraint, length constraint, and orientation constraint.

8. The method according to claims 1, wherein the grading mask also includes one or more special grading regions, each of which includes an outline portion of a piece of the grading mask and at least one special grading formula associated with each special grading region and specifying a constraint to be applied to the portion of the outline during the grading, and, during the grading, the special grading formula associated with a special grading region that contains one or more outline portions of the piece of the article to be graded is applied to the or to each outline portion.

9. A method of creating a grading mask for automatically grading articles of a given type, in particular articles of a garment type, that are formed by assembling a plurality of pieces, said method comprising:

using images of the pieces of a reference article of the given type for a given base size;

positioning the images of the pieces of the reference article in a plane;

creating grading regions, each of the grading regions being defined by a geometrical zone of the plane and containing at least one characteristic point of the piece of the article; and associating each grading region with a grading formula making it possible, in the associated grading region, and as a function of the variation in one or more magnitudes of a scale of measurements, or of a predetermined increment value, to determine a displacement to be applied to each characteristic point contained in said region for going from the base size to another size.

10. The method according to claim 9, wherein the method further comprises creating one or more special grading regions, each of which includes a portion of the outline of the piece of the mask, and in associating each special grading region with at least one special grading formula specifying a constraint to be applied to the portion of the outline during grading.

11. A grading mask for automatically grading articles of a given type, in particular articles of the garment type, that are formed by assembling a plurality of pieces, said mask comprising images of the pieces of a reference article of the same type as the type of the article to be graded and for a given base size, a plurality of geometrical grading regions, each of which contains one or more characteristic points of the piece of the reference article, and grading formulae associated with respective ones of the various regions, each grading formula making it possible, in the associated grading region, and as a function of the variation in one or more magnitudes of a scale of measurements, or of a predetermined increment value, to determine a displacement to be applied to each characteristic point contained in said region for going from the base size to another size.

12. The grading mask according to claim 11, wherein the grading mask further comprises one or more special grading regions, each of which includes a portion of an outline of the piece of the mask and at least one special grading formula associated with each special grading region and specifying a constraint to be applied to the portion of the outline during the grading.

13. A set of grading masks as defined in claim 12, wherein the grading masks comprise digital files stored in a computer-readable medium.

14. A set of grading masks as defined in claim 11, wherein the grading masks comprise digital files stored in a computer-readable medium.

* * * * *